United States Patent [19]

Mizutani

[11] 4,106,452

[45] Aug. 15, 1978

[54] EXHAUST GAS RECIRCULATOR

[75] Inventor: Kohichi Mizutani, Seto, Japan

[73] Assignee: Toyota Jidosha Kogyo Kabushiki Kaisha, Toyota, Japan

[21] Appl. No.: 797,607

[22] Filed: May 16, 1977

Related U.S. Application Data

[63] Continuation of Ser. No. 704,506, Jul. 12, 1976, abandoned.

[30] Foreign Application Priority Data

Mar. 11, 1976 [JP] Japan ..... 51-29250

[51] Int. Cl.[2] ..... F02M 25/06

[52] U.S. Cl. ..... 123/119 A

[58] Field of Search ..... 123/119 A, 117 A

[56] References Cited

U.S. PATENT DOCUMENTS

| | | | |
|---|---|---|---|
| 3,768,452 | 10/1973 | Lewis | 123/119 A |
| 3,800,764 | 4/1974 | Goto et al. | 123/119 A |
| 3,885,537 | 5/1976 | Diehl | 123/119 A |
| 3,930,475 | 1/1976 | Lewis et al. | 123/119 A |
| 3,962,868 | 6/1976 | Matomoto et al. | 123/119 A |
| 3,996,905 | 12/1976 | Dawson | 123/119 A |

*Primary Examiner*—Wendell E. Burns

*Attorney, Agent, or Firm*—Stevens, Davis, Miller & Mosher

[57] ABSTRACT

An exhaust gas recirculator in an internal combustion engine wherein a part of the exhaust gas is supplied to a suction manifold only at the time when the throttle valve is opened and in some time interval immediately after the time afterwards, and the supply of the exhaust gas is stopped in time interval in the steady operation of the engine at the degree of opening of the throttle valve in the above supply period.

3 Claims, 2 Drawing Figures

EXHAUST GAS RECIRCULATOR

This is a Continuation of application Ser. No. 704,506 filed July 12, 1976, now abandoned.

This invention relates to improvements in an exhaust gas recirculator which recirculates a part of a exhaust gas through a suction manifold in an internal combustion engine and reduces poisonous components in the exhaust gas.

An exhaust gas recirculator is known as an expedient for reducing NOx which is one of poisonous components in the exhaust gas of an internal combustion engine. Simultaneously with the reduction of NOx, however, the engine performance is degraded in that the power lowered, the fuel cost rises and the combustion becomes unstable. In order to eliminate these disadvantages, a complicated control device is jointly used.

An object of an exhaust gas recirculator of this invention consists in that a part of the exhaust gas is supplied to a suction manifold only when the throttle valve is opened and in some time interval immediately aferwards, whereas the supply of the exhaust gas can be stopped in the time interval during steady operation of the engine at the same degree of opening of the throttle valve as in the supply period, so that the degradation of the engine performance can be prevented.

Figure 1:
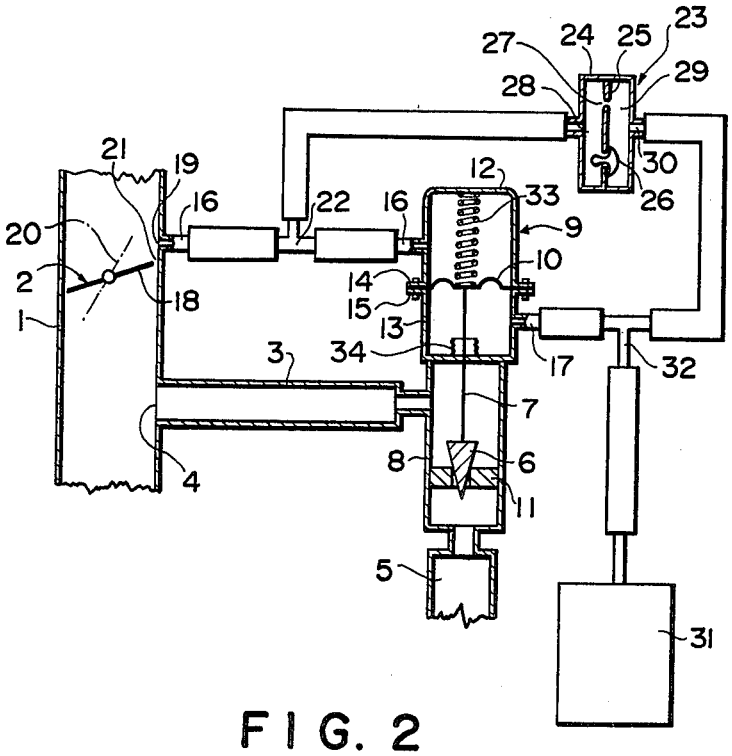
Figure 2:
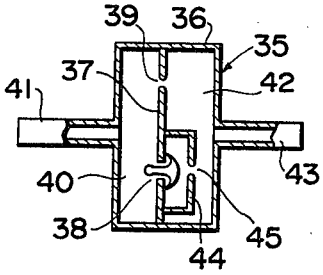

Features and advantages of this invention will become apparent from the following description taken with reference to the accompanying drawing, in which;

FIG. 1 is a schematic side view, partly in section, showing an embodiment of this invention, and FIG. 2 is a schematic sectional view of a negative pressure delaying valve in another embodiment.

In the embodiment illustrated in FIG. 1, port portion 4 of pipe 3 for recirculating exhaust gas is provided downstream of throttle valve 2 of suction manifold 1. An exhaust conduit 5 joined to a suction manifold (not shown) and the pipe 3 are held in communication through an elevating type valve 6.

The upper end of spindle 7 of the valve 6 is secured to diaphragm 10 in case 9 which is partitioned airtight from valve chest 8. By the upward or downward movement of the diaphragm 10, valve 6 ascends or descends, and the clearance between valve seat 11 and valve 6 is opened or closed.

The case 9 is divided into an upper case 12 and a lower case 13 with the diaphragm 10 held therebetween. Both the cases 12 and 13 are integrally coupled by bolts and nuts at respective flange portions 14 and 15.

In the illustrated embodiment, the peripheral edge of diaphragm 10 is interposed and fixed between the flanges 14 and 15.

The upper case 12 defines an upper diaphragm chamber, and is hermetically sealed except for the part communicating with conduit 16. Likewise, the lower case 13 defines a lower diaphragm chamber is hermetically sealed except for the part communicating with conduit 17.

On the other hand, port portion 19 of conduit 16 communicating with the upper case 12 is open to a position slightly upstream (in the direction of opening the valve 2) of an idling opening position 18 of throttle valve 2 in the suction manifold 1, i.e., a position closer to a the carburetor. The port portion 19 is set at a position which is slightly upstream of the idling opening position 18 of throttle valve 2 as stated above and which is downstream of fully open position 20 of valve 2.

Accordingly, when the fore end 21 of throttle valve 2 is situated downstream of the port portion 19, atmospheric pressure is introduced from the port portion 19 into the conduit 16, and when the force end 21 is situated upstream of the port portion 19, a negative pressure is introduced from the port portion 19 into the conduit 16. A conduit 22 branched from the conduit 16 communicates with a negative pressure delaying valve 23.

The negative pressure delaying valve 23 is a known one. A check valve 26 and an orifice 27 are arranged in parallel in partition wall 25 which divides case 24 into two compartments. When the negative pressure acts on the compartment 28 situated on the working surface side of the check valve 26, valve 26 is closed. The compartment 29 on the rear surface side of the valve 26 has negative pressure gradually exerted thereon through orifice 27, and the compartment 29 side comes to have the same negative pressure as that of the compartment 28 side with a predetermined time lag.

Port portion 30 which is one end of the conduit 17 communicating with the lower case 13 is open to the compartment 29 situated on the rear side of the check valve 26 of the negative pressure delaying valve 23.

Numeral 31 in FIG. 1 designates an air tank which communicates with conduit 32 branched from conduit 17.

The diaphragm 10 in case 9 has restoring elasticity by interposing a spring 33 between it and the top part of the upper case 12. At the part of which the spindle 7 of valve 6 penetrates through the bottom of the case 9, a bellows-like seal means 34 is additionally provided to hermetically seal the lower case 13.

The state of the device of the above construction as indicated by solid lines in FIG. 1 corresponds to the idling operation of an internal combustion engine. The atmospheric pressure acts on the port portion 19 of conduit 16, and interior of upper case 12 of the case 9. Besides, the atmospheric pressure acts on the negative pressure delaying valve 23 through conduit 22, opens check valve 26, and acts on the interior of the lower case 13 defining the lower diaphragm chamber through conduit 17. For this reason, the diaphragm 10 assumes a neutral position owing to the balance of the pressures of both the upper and lower chambers and to the elastic force of the spring 33. The spindle 7 descends, the valve 6 comes into close contact with valve seat 11, and valve chest 8 is maintained in the closed state. Therefore, exhaust conduit 5 and pipe 3 are cut off, and the recirculation of the exhaust gas is stopped.

The throttle valve 2 is shifted from such state to the fully open position 20. Then, after the time when the end 21 of the valve 2 has passed through the port portion 19 of conduit 16, the negative suction pressure acts via the port portion 19 and the conduit 16 on the interior of the upper case 12 of case 9 which defines the upper diaphragm chamber.

The interior of the lower case 13 defining the lower diaphragm chamber is under atmospheric pressure as described previously. Owing to the difference of pressure between the negative pressure and the atmospheric pressure, therefore, the diaphragm 10 moves upwards. The valve 6 moves away from valve seat 11 through spindle 7. The exhaust gas is supplied via the exhaust conduit 5 and pipe 3 into the suction manifold 1.

In this case, the negative pressure in the conduit 16 acts via the conduit 22 on the negative pressure delaying valve 23. The check valve 26 is closed by the negative pressure. Consequently, the negative pressure gradually acts on he interior of the lower case 13 defining the lower diaphragm chamber through orifice 27 and via conduit 17. As both the upper and lower cases 12 and 13 are subjected to equal negative pressure with a predetermined time lag, the diaphragm 10 is gradually moved downwards to a neutral position owing to the elastic force of spring 33. When the interiors of both the upper and lower cases 12 and 13 have become equally pressurized, valve 6 comes into close contact with valve seat 11. As set forth previously, the communication between the exhaust conduit 5 and pipe 3 is cut off, and the recirculation of the exhaust gas is stopped.

The magnitude of the foregoing time lag is influenced by the diameter of the orifice and the volumes of the internal spaces of the compartment 29 of the negative pressure delaying valve 23, the conduit 17 and the lower case 13 defining the lower diaphragm chamber. Therefore, when conduit 17 is additionally provided with an air tank 31, the time lag can be set at a greater value. Conversely, where the diameter of the orifice is small or where the volumes of the internal spaces of the members other than the air tank 31 are sufficiently large, the air tank 31 can be omitted.

The exhaust gas is recirculated only when the throttle valve 2 has been opened, as is most conspicuous during the emission of NOx, and during the time interval immediately thereafter. Within a time interval of the steady operation at the degree of opening, the recirculation of the exhaust gas is stopped, and the degradation of the engine performance can be prevented.

When the throttle valve 2 is returned from the steady operation position to the idling opening position 18, atmospheric pressure is introduced via the port portion 19 and the conduit 16 into both the upper and lower cases 12 and 13 in which the diaphragm 10 has already occupied the neutral position as stated above. Thus, preparations are made for the time when the throttle valve 2 is opened again.

FIG. 2 shows a negative pressure delaying valve 35 in another embodiment. As in the valve 23 shown in FIG. 1, a check valve 38 and orifice 39 are arranged in parallel in partition wall 37 which divides case 36 into two compartments, a negative pressure or the atmospheric pressure acts through conduit 41 on compartment 40 situated on the side of the working surface of check valve 38, and compartment 42 situated on the side of the rear surface of valve 38 communicates through conduit 43 with the lower diaphragm chamber. The rear surface of check valve 38 is masked with a separate cover 44 inside the compartment 42, and it communicates with the compartment 42 through an orifice 45 provided in the cover 44.

According to this embodiment, when the throttle valve 2 is returned from the fully open position 20 to the idling opening position 18 in FIG. 1 and the atmospheric pressure is introduced from the conduit 41 into the compartment 40, the check valve 38 is immediately opened. Also the interior of cover 44 at the rear of check valve 38 is instantly subjected to atmospheric pressure, and the atmospheric pressure inside cover 44 is led to compartment 42 with a predetermined time lag owing to the presence of the orifice 45. Of course, the atmospheric pressure is also introduced from the orifice 39. Therefore, the atmospheric pressure is introduced into the lower diaphragm chamber through compartment 42 and conduit 43 with a predetermined time lag which depends on the characteristics of both the orifices.

As the result, the lower diaphragm chamber is maintained at negative pressure within a certain time interval at the beginning of the time lag. Accordingly, even when the throttle valve 2 is opened to the fully open position 20 and the negative pressure acts on the upper diaphragm chamber with a certain time interval, the diaphragm hardly moves because the lower diaphragm chamber is maintained at the negative pressure as described above. During the period, therefore, valve 6 is not opened and there is no recirculation of the exhaust gas.

That is, in case where, even when the throttle momentarily closed during steady operation and is opened again in a short time thereafter exhaust gas recirculation does not occur and wasteful degradation of the engine performance is prevented.

As described above, according to this invention, the recirculation of exhaust gas is carried out only at the time when the throttle valve is opened and in some time interval immediately after that time, and it is stopped during the time interval of steady operation at the degree of opening of the valve, i.e., during a period when the emission of NOx is small. Thus, the invention has the effect that the degradation of the engine performance can be prevented. Another effect is that the recirculator is simple in structure and comparatively low in cost.

What I claim is:

1. An exhaust gas recirculation system for use in an engine provided with an intake manifold and throttle valve mounted therein comprising:

first conduit means for recirculating exhaust gas from said engine to said intake manifold at a position downstream from said throttle valve, valve actuator means including a diaphram separating two pressure chambers, valve means responsive to movement of said diaphram for opening and closing said first conduit means, second conduit means coupling a first of said two pressure chambers with a port in said intake manifold located slightly upstream of an idle opening position of said throttle valve, a negative pressure delaying valve, and a third conduit means coupling the second of said two pressure chambers with said second conduit means through said negative pressure delaying valve.

2. The exhaust gas recirculation system according to claim 1, wherein said delaying valve comprises:

a housing containing input and output ports, a barrier positioned in said housing and between said input and output ports, said barrier having mounted therein a check valve and a juxtaposed orifice, and a cover containing another orifice positioned over the rear surface of said check valve.

3. An exhaust has recirculation system as in claim 1, wherein said third conduit has an air tank coupled thereto at a position between the coupling of said second pressure chamber and said negative pressure delaying valve to said third conduit.

* * * * *